US008069507B2

(12) United States Patent
Didehvar et al.

(10) Patent No.: US 8,069,507 B2
(45) Date of Patent: Dec. 6, 2011

(54) ADJUSTABLE CURVED SHOWER CURTAIN ROD ASSEMBLY

(75) Inventors: Kaveh Didehvar, Hockessin, DE (US); Jeffrey Harwanko, Wilmington, DE (US)

(73) Assignee: Zenith Products Corporation, New Castle, DE (US)

( * ) Notice: Subject to any disclaimer, the term of this patent is extended or adjusted under 35 U.S.C. 154(b) by 1160 days.

(21) Appl. No.: 11/833,044

(22) Filed: Aug. 2, 2007

(65) Prior Publication Data

US 2008/0028513 A1 Feb. 7, 2008

Related U.S. Application Data

(60) Provisional application No. 60/821,324, filed on Aug. 3, 2006.

(51) Int. Cl.
*A47K 3/00* (2006.01)

(52) U.S. Cl. ..... 4/610

(58) Field of Classification Search ..... 4/557–558, 4/610, 607–608

See application file for complete search history.

(56) References Cited

U.S. PATENT DOCUMENTS

| | | | | |
|---|---|---|---|---|
| 1,675,111 | A | 6/1928 | Kenney | |
| 2,131,156 | A | 9/1938 | Yardley | |
| D119,576 | S | 3/1940 | Kirsch | |
| 2,219,075 | A | 10/1940 | Veau | |
| 2,383,104 | A | 8/1945 | Allen | |
| 2,778,030 | A | 1/1957 | Goche | |
| 3,418,665 | A | 12/1968 | Long | |
| 4,496,059 | A | 1/1985 | Leiter | |
| 4,754,504 | A | 7/1988 | Cellini | |
| D374,167 | S | 10/1996 | Scholl | |
| D379,297 | S | 5/1997 | Shires | |
| 5,662,297 | A * | 9/1997 | Christensen et al. | 211/105.1 |
| D393,390 | S | 4/1998 | Gottwald | |
| D397,928 | S | 9/1998 | Wise | |
| 5,894,610 | A | 4/1999 | Winter | |
| D426,142 | S | 6/2000 | Moore | |
| 6,216,287 | B1 | 4/2001 | Wise | |
| 6,263,523 | B1 * | 7/2001 | Moore | 4/610 |
| 6,694,543 | B2 * | 2/2004 | Moore | 4/610 |
| 6,715,163 | B1 | 4/2004 | Cunningham | |
| D489,249 | S | 5/2004 | Moore | |
| D498,663 | S | 11/2004 | Moore | |
| 7,024,706 | B2 * | 4/2006 | Hess | 4/557 |

(Continued)

OTHER PUBLICATIONS http://www.google.com/imgres?imgurl=http://www.masterformtool.com/images%255Cclevis_bracket_slice.gif&imgrefurl=http://www.masterformtool.com/catalog.asp%3Fcategory%3D2%26class%3D11%26sublass%3D0%26part%3D0&usg=YBufqK0inJw2C7IUBxtfPoTSmWc=&h=200&w=210&sz=20&hl=en&start=0&zoom=1&tbnid=GNXQi4b9AFxP_M;&tbnh=160&tbnw=168&prev=/images%3Fq%3Dmasterformtool.com%2Bclevis%2Bbrackets%26um%3D1%26h1%3Den%26safe%3Dactive%26sa%3DN%26rls%3Dcom.microsoft:en-us%26biw%3D1132%26bih%3D653%26tbs%3Disch:1&um=1&itbs=1&iact=rc&dur=250& ei=awQuTYSHNcGB8gadgZHDCg&oei=awQuTYSHNcGB8gadgZHDCg&esq=1&paqe=1&ndsp=11&ved=1t:429,r :0,s:0&tx=139&ty=93; "Masterform Tool Company; Clevis Brackets", web page printout date: Feb. 11, 2010; original web posting date and product availability date: unknown, 1 page.

(Continued)

*Primary Examiner* — Lori Baker
(74) *Attorney, Agent, or Firm* — Panitch Schwarze Belisario & Nadel LLP

(57) ABSTRACT

A shower curtain support system includes a first rod having a first arcuate portion and a first end portion and a second rod having a second arcuate portion and a second end portion. The second arcuate portion is telescopically mounted within the first arcuate portion. A first end support is removably and pivotably mounted to the first end portion and a second end support is removably and pivotably mounted to the second end portion.

7 Claims, 3 Drawing Sheets

U.S. PATENT DOCUMENTS

| | | | | |
|---|---|---|---|---|
| D542,897 | S | 5/2007 | Harwanko | |
| D552,455 | S | 10/2007 | Moore | |
| D557,590 | S | 12/2007 | Moore | |
| D567,637 | S | 4/2008 | Moore | |
| 2004/0178310 | A1* | 9/2004 | Marion | 248/251 |
| 2007/0006378 | A1* | 1/2007 | Moore | 4/558 |
| 2007/0174956 | A1* | 8/2007 | Heaslip | 4/558 |

OTHER PUBLICATIONS http://www.google.com/imgres?imgurl=http://images.drillspot.com/pimages/123/12341_300.jpg&imqrefurl=http://www.drillspot.com/products/40400/ingersoll-rand_20547_clevis_bracket&usg=bQ-zcMQcoJUuUE-ts-b4cFeNf7Q=&h=300&w=300&sz=77&hl=en&start=0&zoom=1&tbnid=ukjYwAWJBN1i3M:&tbnh=131&tbnw=131&prev=/images%3Fg%3Ddrillspot%2Bclevis%2Bbracket%26um%3D1%26hl%3Den%26safe%3Dactive%26sa%3DN%26rls%3Dcom.microsoft:en-us%26biw%3D1132%26bih%3D653%26tbs%3Disch:1&um=1&tbs=1%iact=rc&dur=531&ei=zwQuTce9Do6G4Qbcu5iGCQ&oei=zwQuTce9Do6G4Qbcu5iGCQ&esq=1&page=1&ndsp=18&ved=1t:429,r:0,s:0&tx=84&ty=62; "Medium—to Heavy-Duty Repairable Cylinders", Aro—20546 Clevis Bracket, SKU—40769, web page printout date: Feb. 11, 2010; original web posting date: unknown, 1 page.

http://www.google.com/imgres?imgurl=http://www.aggressivehydraulics.com/Common/images/custom/products/ClevisBracket.png&imgrefurl=http://www.aggressivehydraulics.com/Mounts/&usg=92nGtlyDBpCV42tTKZyU3E3YtIM=&h=280& w=600&sz=127&hl=en&start=0&zoom=1&tbnid=alrqXwO6hgAGbM:&tbnh=81&tbnw=174&prev=/images%3Fg%3DAggressively%2Bhydraulics%2Bclevis%2Bbracket%26um%3D1%26hl%3Den%26safe%3Dactive%26sa%3DN%26biw%3D1148%26bih%3D653%26tbs%3Disch:1&um=1& itbs=1&iact=hc&vpx=89&vpy=133&dur=31&hovh=153&hovw=329&tx=184&ty=81&ei=EwQuTYOoEcOB8gbqo6SxCq&oei=EwQuTYOoEcOB8gbqo6SxCg&esq=1&paqe=1&ndsp=15&ved=1t:429,r:0,s:0; "Clevis Bracket, Material: Forging, Weldment, or Ductile Iron", web page printout date: Feb. 11, 2010; original web posting date: unknown, 1 page.

http://plumbing. hardwarestore.com/51-283-shower-rods-and-holders/stanless-steel-curved-shower-rod-609421.aspx; "Stanless Steel Curved Shower Rod, 1" × 5'"; web page printout date: Feb. 10, 2010; original web posting date: unknown, 1 page.

* cited by examiner

ADJUSTABLE CURVED SHOWER CURTAIN ROD ASSEMBLY

CROSS-REFERENCE TO RELATED APPLICATIONS

This application claims the benefit of U.S. Provisional Patent Application No. 60/821,324, filed Aug. 3, 2006 entitled "Adjustable Curved Shower Curtain Rod Assembly," which is incorporated by reference herein in its entirety.

BACKGROUND OF THE INVENTION

The present invention relates generally to bathtub shower enclosures, and more particularly to an adjustable curved shower curtain rod assembly that combines the advantages of a curved shape to hold a shower curtain directly above the curved contour of the interior surface of a bathtub with a slidably adjustable length to allow the shower rod to be mounted above bathtubs of different sizes, and adjustable end supports to allow the shower rod to be mounted to shower walls at different angles and mounted to the end supports after the end supports are mounted.

In the bathtubs of many bathrooms, a shower nozzle is mounted on one wall so that the user of the bathroom may choose to take a shower instead of a bath within the same bathtub enclosure. Typically, the bathtub enclosure consists of walls on three sides of the bathtub, two side walls and one rear wall, but the fourth side of the bathtub is open to permit entry to and egress from the bathtub. When using the bathtub enclosure to take a shower, the water spray is contained within the bathtub enclosure on three sides by the walls, but water spray can spill into the bathroom by way of the fourth side of the bathtub where there is no wall. Thus, it has long been known in the art that a shower curtain can be suspended from a shower curtain rod that has been attached to the two side walls to enclose the previously open fourth side of the bathtub. Such shower curtain rods have typically comprised a straight rod, of fixed or adjustable length, attached to the two side walls in a fixed position.

However, bathtubs are sold by many different manufacturers in many different shapes and sizes, and are installed by many different workers in many different room configurations. The result of these combined differences is the propagation of myriad sizes of bathtub shower enclosures, and thus there can be no one fixed size of shower curtain rod that will properly fit all or most bathtub enclosures. In addition, many bathtubs are generally oval in shape, and thus suspending a shower curtain from a straight shower curtain rod results in the shower enclosure formed by the shower curtain to be smaller than the base, or footprint, of the bathtub. In addition, using a straight shower curtain rod may result in excessive water spray entering the bathroom from the bathtub shower enclosure around the ends of the shower curtain.

Curved shower curtain rods have typically been used, but these rods have been of fixed length, have required modifications to make them fit in a particular bathtub shower enclosure, or are difficult to install and adjust. Different configurations of mounting brackets, including hinged and ball-and-socket devices, have been used to mount shower curtain rods of fixed length on the bathtub shower side walls, but these devices require the use of a rod of fixed length or an integral mounting bracket, and thus also require modifications to make the rod fit within a particular bathtub shower enclosure. To modify the fixed-length rod to fit within a particular bathtub shower enclosure, it has been necessary to remove the entire shower curtain rod assembly from its installed position on the side walls, cut or adjust the shower curtain rod, and reinstall it on the side walls. This process may need to be repeated several times to achieve an approximate fit. Moreover, if one attempted to modify the length of the rod while it was in an installed position, the attachment of the rod to the side walls could weaken or break. This is particularly problematic if the rod is to be mounted to dry wall.

What is needed, but not provided in the prior art, is an adjustable curved shower curtain rod assembly that is shaped to conform to the curvature of a bathtub or expand the width of a conventional rectangular tub, can be infinitely adjusted in length easily and quickly, and is mounted to the side walls by mounting yokes that are designed to permit adjustment of the rod length, in an installed position, while maintaining constant attachment strength of the rod to the side walls.

BRIEF SUMMARY OF THE INVENTION

Briefly stated, the present invention is directed to a shower curtain support system. The shower curtain support system includes a first rod having a first arcuate portion and a first end portion and a second rod having a second arcuate portion and a second end portion. The second arcuate portion is telescopically mounted within the first arcuate portion. A first end support is removably and pivotably mounted to the first end portion and a second end support is removably and pivotably mounted to the second end portion.

In another aspect, the present invention is directed to a method of installing a shower curtain support system. The method includes the steps of mounting a first end support to a first wall, mounting a second end support to a second wall where the second wall opposes the first wall, telescopically inserting an arcuate portion of a second rod having a second end portion into an arcuate portion of a first rod having a first end portion, adjusting the length of the assembled first and second rods such that yoke holes in the first and second end portions align with lug holes in lugs extending from the first and second end supports and inserting a lug pin through each of the lugs and yoke holes to secure the first and second rods to the first and second supports, respectively.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
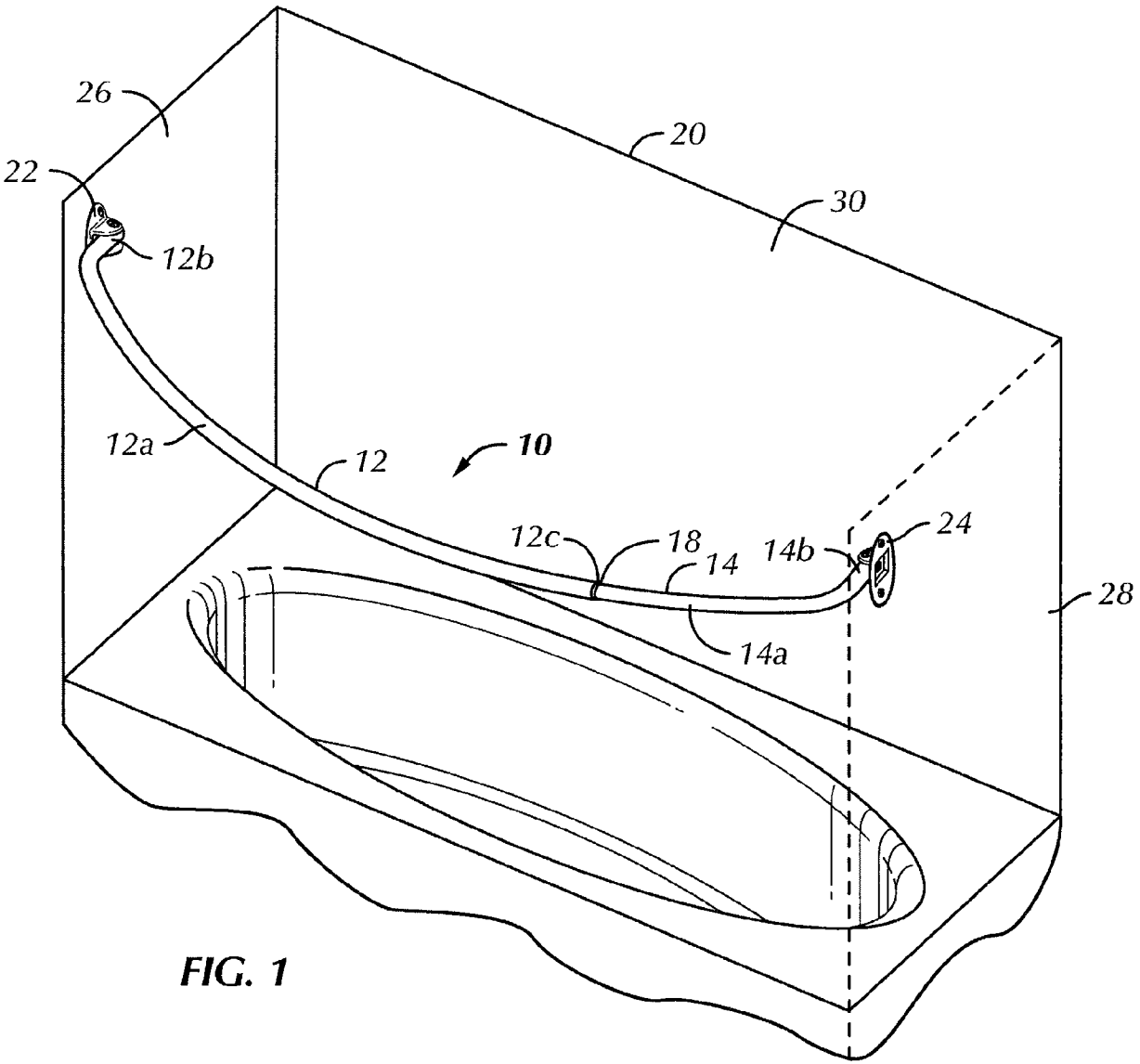
FIG. 1 is a top perspective view of a preferred embodiment of an adjustable curved shower curtain rod assembly installed in a bathtub shower in accordance with the present invention.

Certain terminology is used in the following description for convenience only and is not limiting. The words "right,"

"left," "lower" and "upper" designate directions in the drawings to which reference is made. The words "inwardly" and "outwardly" refer to directions toward and away from, respectively, the geometric center of an adjustable curved shower rod assembly in accordance with the present invention, and designated parts thereof. Unless specifically set forth herein, the terms "a", "an" and "the" are not limited to one element but instead should be read as meaning "at least one." The terminology includes the words noted above, derivatives thereof and words of similar import.

Figure 2:
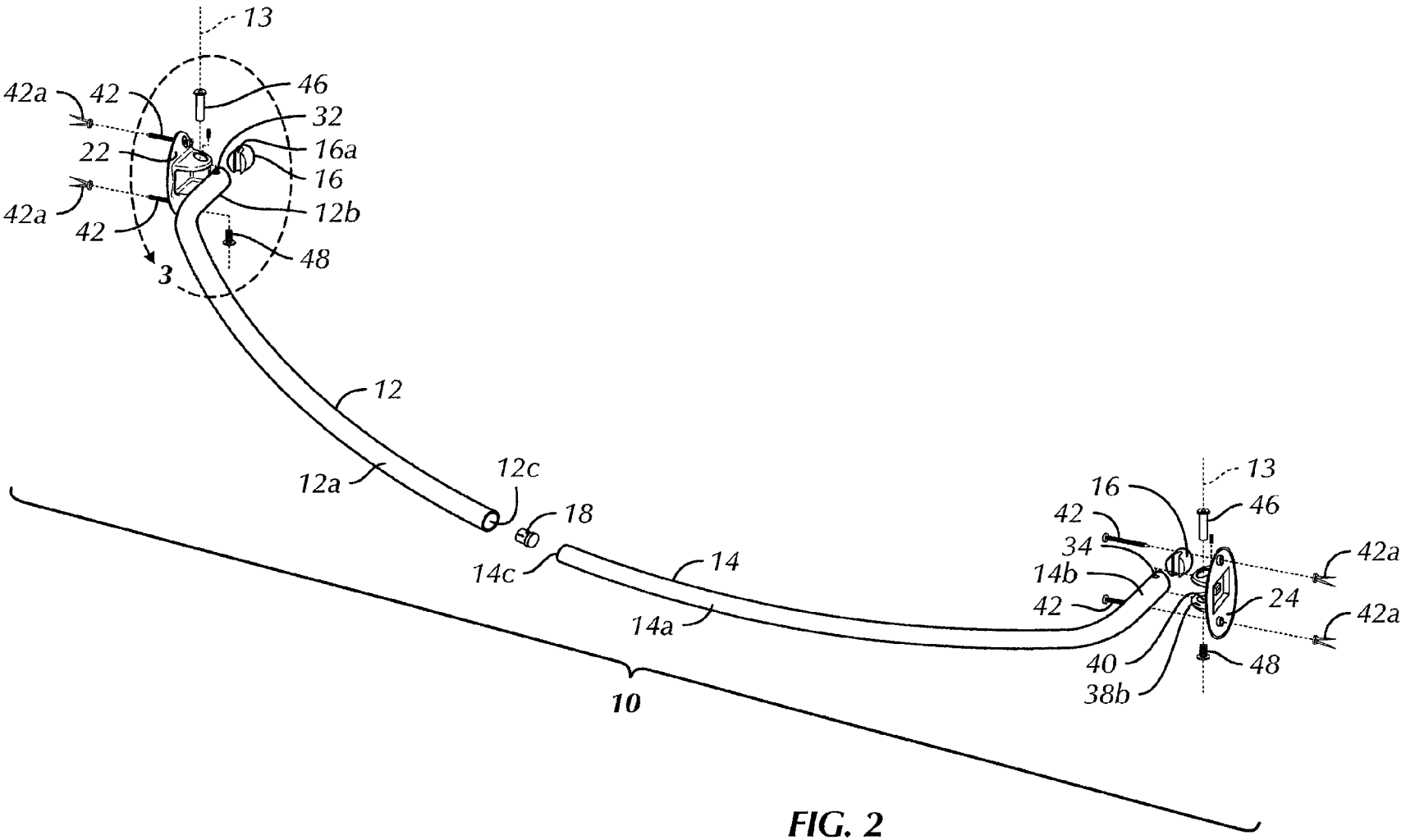
FIG. 2 is an exploded, top perspective view of the adjustable curved shower curtain rod assembly shown in FIG. 1.
Figure 3:
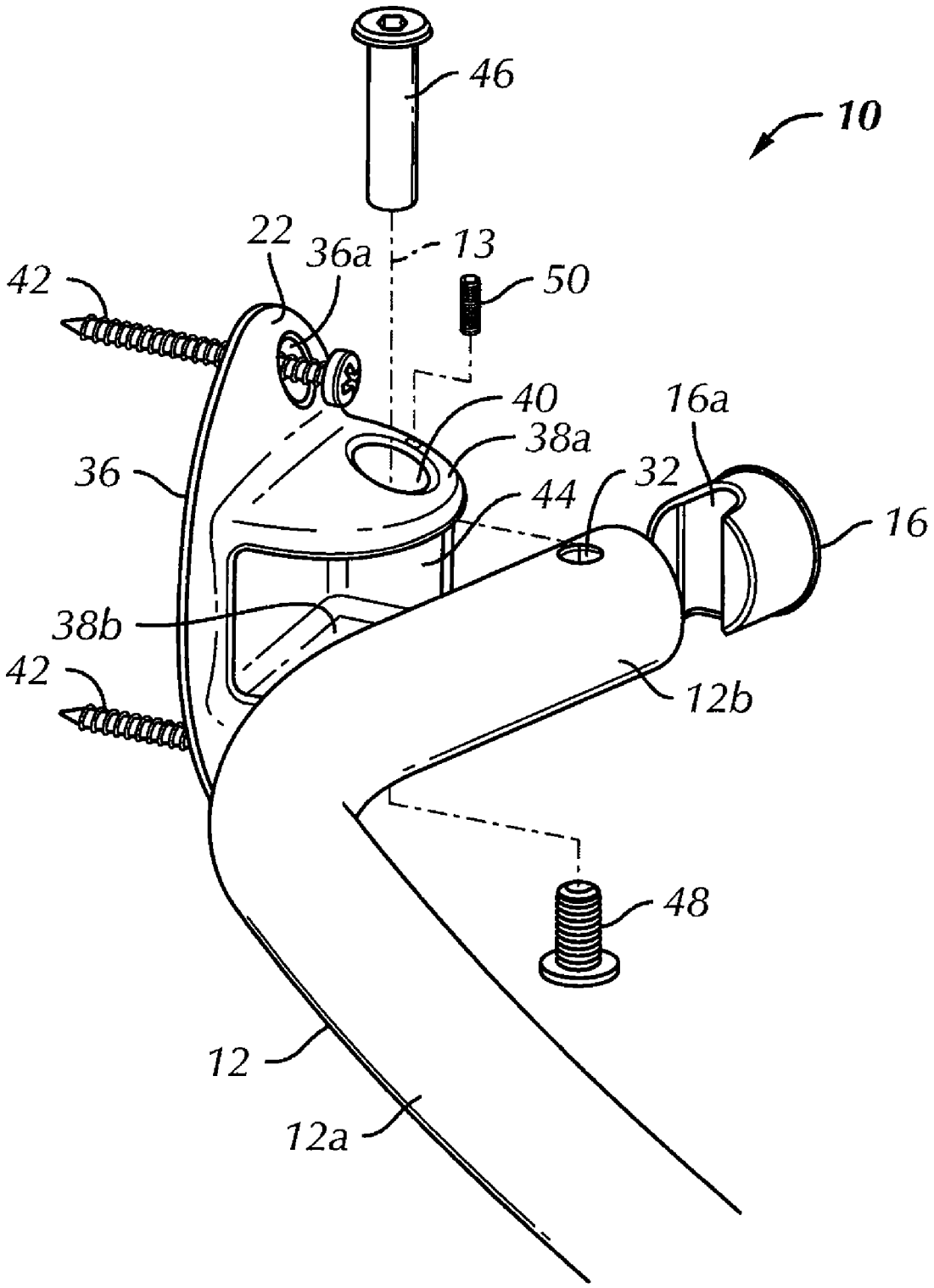
FIG. 3 is an enlarged exploded fragmentary view of a portion of the adjustable curved shower curtain rod assembly of FIG. 1, taken from insert ellipse 3 of FIG. 2.

Referring to the drawings in detail, wherein like reference numerals indicate like elements throughout, there is shown in FIGS. 1-3 a preferred embodiment of an adjustable curved shower curtain rod assembly ("assembly"), generally designated 10, in accordance with the present invention.

Referring to FIGS. 1-3, the assembly 10 includes a first rod 12 that has a first arcuate portion 12*a* and a first end portion 12*b* and a second rod 14 that has a second arcuate portion 14*a* and a second end portion 14*b*. The first and second end portions 12*b*, 14*b* are preferably generally straight and include a plug 16, preferably comprised of polymeric material. The plugs 16 preferably include a vertically extending groove 16*a* and are removeably mountable in hollow ends of the first and second end portions 12*b*, 14*b*. The second arcuate portion 14*a* is telescopically mounted within the first arcuate portion 12*a*. A sleeve 18 is preferably mounted to a first arcuate end 12*c* opposite the first end portion 12*b* of the first rod 12. The sleeve 18 receives a second arcuate end 14*c* of the second rod 14 to accommodate the telescopic or sliding movement of the first rod 12 relative to the second rod 14. The sleeve 18 is preferably comprised of a polymeric material but it is within the spirit and scope of the present invention that the sleeve 18 be comprised of any material for assisting in securing the first and second rods 12, 14, formed integrally into one of the first or second rods 12, 14 or may be omitted entirely. In addition, this plug 16 is not limited to being included in the assembly 10, but is preferred to close the open end of the first and second end portions 12*b*, 14*b* but may be integrally formed or otherwise configured as would be apparent to one having ordinary skill in the art.

When assembled, the first and second rods 12, 14 form a convex center segment and the first and second end portions 12*b*, 14*b* extend inwardly toward a bathtub shower 20 relative to a bathtub shower 20, the direction of convexity. Though the first rod 12 preferably receives the second rod 14, it is within the spirit and scope of the present invention that the opposite configuration be used. The telescopic movement of the first rod 12 relative to the second rod 14 permits modification of the overall length of the assembly 10 to adapt to different sized bathtub showers 20. The first and second rods 12, 14 are preferably comprised of hollow lightweight metallic tubing but it is within the spirit and scope of the present invention that the first and second rods 12, 14 be at least partially solid and constructed of any material such as a polymeric material, or other material that is able to take on the general shape and size of the first and second rods 12, 14 and withstand the normal operating conditions of the assembly 10.

A first end support 22 is mounted to a first wall 26 of the bathtub shower 20 and a second end support 24 is mounted to a second wall 28 opposite from the first wall 26. The first end portion 12*b* is removably and pivotably mounted to the first end support 22 and the second portion 14*b* about pivot axis 13 is removably and pivotably mounted to second end support 24 about pivot axis 13. A shower curtain (not shown) is suspended from the first and second rods 12, 14 with shower curtain hooks (not shown) to generally prevent water from splashing out of the bathtub shower 20. The assembly 10 suspends the shower curtain outwardly relative to a rear wall 30 of the bathtub shower 20 in order to provide additional space within the bathtub shower enclosure.

Referring to FIGS. 2 and 3, the first end portion 12*b* includes a first lug hole 32 and the second end portion 14*b* includes a second lug hole 34, each of which preferably extends vertically through the first rod or second rod 12, 14. The first and second end supports 22, 24 are preferably in the form of yokes for capturing the first and second end portion 12*b*, 14*b* in a stable manner. Referring specifically to FIG. 3, the first end support 22 includes a back plate 36, generally parallel to the first wall 26, and a pair of spaced apart lugs 38*a*, 38*b* extending generally perpendicularly from the back plate 36. A yoke hole 40 is preferably provided in each of the lugs 38*a*, 38*b*. The back plate 36 includes a pair of mounting holes 36*a* for receiving fasteners 42 therethrough to secure the first end support 22 to the first wall 26. Fastener anchors 42*a* may be used to help further secure the first and second end supports 22, 24 to the first and second walls 26, 28. Fastener anchors 42*a* are particularly useful if the first and second walls 26, 28 are comprised of dry wall. The back plate 36 is not limited to being secured to walls 26, 28 using the described hardware and may be secured to the walls 26, 28 in nearly any manner utilizing nearly any hardware, such as adhesive binding, clamping, welding or other like recurring mechanisms or methods.

An orthogonal wall 44 preferably extends between the lugs 38 from the back plate 36 and is perpendicular to each of the legs 38*a*, 38*b*. The orthogonal wall 44 is preferably skewed at an angle with respect to the back plate 36 such that the orthogonal wall 44 is parallel to the plug 16 in at least one position corresponding to a preferred convexity of the assembled first and second rods 12, 14 for snugly receiving the first end portion 12*b*. A lug pin 46 is inserted through the yoke holes 40 and secured with a lug pin end 48 for pivotably attaching the first and second rods 12, 14 to the first and second end supports 22, 24. The groove 16*a* preferably receives the lug pin 46 for increased stability and strength. At least one support member 50 may be inserted through the lugs 38 and into contact with the first end portion 12*b* to limit off axis movement of the first end portion 12*b* about the lug pin 46 and prevent movement of the first rod 12, 14 with respect to the first end supports 22 caused as a result of space left between the first end portion 12*b* and the lugs 38*a*, 38*b*. The support members 50 generally limits vertical movement of the first and second rods 12, 14 with respect to the first and second end supports 22, 24. The first end support 22 is preferably made from a lightweight, high strength material, such as aluminum or steel, but could be made of other materials, such as a polymeric material, without departing from the spirit and scope of the invention.

The first end support 22 is preferable a mirror image of the second end support 24. For convenience in the description and clarity in the drawings, only the first end support 22 is described in detail and completely labeled in the drawings with the understanding that the second end support 22 includes similar features.

To commence installation of the assembly 10 in a bathtub shower 20, the first end support 22 is mounted to the first wall 26 and the second end support 24 is mounted to the opposing second wall 28. In the installed position, the back plates 36 are positioned in facing engagement with the first and second walls 26, 28 and are preferably mounted at generally the same height such that the first and second rods 12, 14 will be generally horizontal in the mounted configuration. The second rod 14 is inserted into the first rod 12 and the rods 12, 14 are slidably moved relative to each such that the length of the first and second rods 12, 14 fits between the first and second end supports 22, 24. The first lug hole 32 is aligned with the yoke hole 40 and the lug pin 46 is urged through the yoke holes 40. The lug pin end 48 is secured to the lug pin 46 to secure the first rod 12 to the first wall 26. The second lug hole 34 is then aligned with the yoke holes 40 of the second end support 24 and the lug pin 46 is urged through the yoke holes 40. The lug pin end 48 is secured to the lug pin 46 to secure the second rod 14 to the second wall 28 (to further secure the second rod 14 to the lug 38*a*). The support member 50 are then inserted. The shower curtain hooks (not shown) and shower curtain (not shown) are mounted to the first and second rods 12, 14 to enclose the bathtub shower 20 and prevent water spray from splashing out of the bathtub shower 20.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims. Though the above method of installation is preferred, it is within the spirit and scope of the present invention that the installation steps be preferred in a different order or additional steps be included.

We claim:

1. A shower curtain support system comprising:

a first rod having a first arcuate portion and a first end portion;

a second rod having a second arcuate portion and a second end portion, the second arcuate portion being telescopically mounted within the first arcuate portion;

a first end support removably and pivotably mounted to the first end portion; and a second end support removably and pivotably mounted to the second end portion, the first and second end supports each including a back plate and a pair of spaced apart lugs extending generally perpendicularly from the back plate, each lug having a yoke hole, the first and second end supports each including an orthogonal wall extending between the lugs and the back plate and skewed at an angle for receiving the first and second end portions in a snug fashion.

2. The shower curtain support system of claim 1, wherein the first and second end supports are yokes.

3. The shower curtain support system of claim 1, wherein a sleeve is mounted to a first arcuate end opposite one of the first and second end portions, the sleeve receiving a second arcuate end opposite the second end portion of the other of the first and second end portions for accommodating the telescopic movement of the first rod relative to the second rod.

4. The shower curtain support system of claim 1, wherein the first and second end portions are generally straight.

5. The shower curtain support system of claim 4, wherein the first and second rods form a convex segment and the first and second end portions extend inwardly toward the direction of convexity.

6. The shower curtain support system of claim 1, wherein a lug pin extends through each of the lugs and through first and second lug holes in the first and second end portions for pivotably attaching the first and second rods to the first and second end supports.

7. The shower curtain support system of claim 6, wherein the lug pins are removable when the first and second end supports are installed to a wall.

* * * * *